US010196077B2

(12) United States Patent
Sornik et al.

(10) Patent No.: US 10,196,077 B2
(45) Date of Patent: Feb. 5, 2019

(54) DEVICE FOR CHANGING THE DIRECTION OF TRAVEL OF A RAIL-BOUND VEHICLE, RAIL-BOUND RIDE HAVING SUCH A DEVICE, AND METHOD FOR OPERATING SUCH A DEVICE

(71) Applicant: MACK RIDES GMBH & CO. KG, Waldkirch (DE)

(72) Inventors: Frank Sornik, Waldkirch (DE); Dennis Gordt, Emmendingen (DE)

(73) Assignee: MACK RIDES GMBH & CO. KG, Waldkirch (DE)

( * ) Notice: Subject to any disclaimer, the term of this patent is extended or adjusted under 35 U.S.C. 154(b) by 203 days.

(21) Appl. No.: 15/035,703

(22) PCT Filed: Oct. 6, 2014

(86) PCT No.: PCT/EP2014/071326

§ 371 (c)(1),
(2) Date: May 10, 2016

(87) PCT Pub. No.: WO2015/113657

PCT Pub. Date: Aug. 6, 2015

(65) Prior Publication Data

US 2016/0288809 A1 Oct. 6, 2016

(30) Foreign Application Priority Data

Jan. 28, 2014 (DE) ..... 10 2014 101 007

(51) Int. Cl.
*B61J 1/08* (2006.01)
*A63G 7/00* (2006.01)
(Continued)

(52) U.S. Cl.
CPC *B61J 1/08* (2013.01); *A63G 7/00* (2013.01); *A63G 21/04* (2013.01); *A63G 21/14* (2013.01); *B61J 1/02* (2013.01)

(58) Field of Classification Search
CPC ..... B61J 1/00; B61J 1/02; B61J 1/12
See application file for complete search history.

(56) References Cited

FOREIGN PATENT DOCUMENTS

CN 1 347 334 A 5/2002
CN 1 468 130 A 1/2004
(Continued)

OTHER PUBLICATIONS

German PTO office action for parallel application 10 2014 101 007.8, dated Jun. 5, 2014.
(Continued)

*Primary Examiner* — Robert J McCarry, Jr.
(74) *Attorney, Agent, or Firm* — William Gray Mitchell

(57) ABSTRACT

The invention relates to a device for changing the direction of travel of a rail-bound vehicle, comprising a feeding rail section, a removing rail section, and a connecting rail section, which can be moved from a first position, in which the connecting rail section is arranged in relation to the feeding rail section in such a way that the rail-bound vehicle can drive onto the connecting rail section, to a second position, in which the connecting rail section is arranged in relation to the removing rail section in such a way that the vehicle can drive onto the removing rail section, by means of a motion comprising at least one rotational motion about an axis of the rotational motion. The invention further relates to a rail-bound ride having such a device, and to a method for operating such a device.

18 Claims, 2 Drawing Sheets

(51) Int. Cl.

| | |
|---|---|
| ***A63G 21/14*** | (2006.01) |
| ***A63G 21/04*** | (2006.01) |
| ***B61J 1/02*** | (2006.01) |

(56) References Cited

FOREIGN PATENT DOCUMENTS

| | | | | | |
|---|---|---|---|---|---|
| CN | 1 720 088 | A | | 1/2006 | |
| CN | 103505878 | A | | 1/2014 | |
| DE | 4200567 | A1 | | 7/1993 | |
| DE | 10135365 | A1 | | 1/2003 | |
| DE | 10135368 | A1 | | 1/2003 | |
| EP | 1 202 780 | A1 | | 5/2002 | |
| JP | 2006/312431 | A | | 11/2006 | |
| JP | 2006312431 | | * | 11/2006 | ..... B61J 1/04 |
| WO | WO 00/34 100 | A1 | | 6/2000 | |
| WO | WO 01/05478 | A1 | | 1/2001 | |
| WO | WO 03 09914 | A1 | | 2/2003 | |

OTHER PUBLICATIONS

JPO office action for parallel application 2016-565552, dated Oct. 19, 2017.

International search report for related application PCT/EP2014/071326, dated Dec. 18, 2014.

SIPO office action for parallel application 2014 8007 4405.8, dated Aug. 2, 2017.

* cited by examiner

DEVICE FOR CHANGING THE DIRECTION OF TRAVEL OF A RAIL-BOUND VEHICLE, RAIL-BOUND RIDE HAVING SUCH A DEVICE, AND METHOD FOR OPERATING SUCH A DEVICE

CROSS REFERENCE TO RELATED APPLICATIONS

This patent application claims priority International Patent Application PCT/EP2014/071326, filed on Oct. 6, 2014, and thereby to German Patent Application 10 2014 101 007.8, filed on Jan. 28, 2014.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The present invention relates to a device for changing direction of travel of a rail-bound vehicle, a rail-bound ride comprising such a device and a method of operating such a device.

Background of the Invention

Rail-bound rides, particularly roller coasters, are some of the most favored attractions of amusement parks, folk festivals, and fairs. Particularly positive effects upon the amusement experienced when using such rides, increasing the thrill, include those in which a situation of danger is suggested, which then does not happen. In addition to steep declines and drop sections, tight curves generating the feeling that the vehicle is thrown off the track, and effects suggesting a seemingly unavoidable collision are here particularly also sudden and unexpected changes of the direction of motion, and thus a plurality of devices have been developed to change the direction of motion of a rail-bound vehicle.

For example, a rotary device is known from DE 42 00 567 A1 for such a vehicle with a feeding rail section and a removing rail section, which are located in a level, and with a connecting rail section rotational about an axis aligned vertical in reference to the level defined by the feeding rail section and the removing rail section; a roller coaster is known from DE 101 35 365 in which a connection rail section embodied as a rocker can form a transition from a feeding rail section showing an incline to a removing rail section with a decline; and from DE 101 35 368 A1 a device is known for changing the direction of motion of a rail-bound vehicle in which in addition to a rotary and a rocker motion, as disclosed in the two above-stated publications, additionally a raising or lowering of the connecting rail section occurs.

The objective of the invention comprises providing a device for changing the direction of motion of a rail-bound vehicle which further increases the amusement and thrill when using a ride with rail-bound vehicles. This objective is attained in a device for changing the direction of motion of a rail-bound vehicle, a rail-bound ride with a device for changing the direction of motion of a rail-bound vehicle and a method for operating a device for changing the direction of motion of a rail-bound vehicle, each as described herein.

BRIEF SUMMARY OF THE INVENTION

In a preferred embodiment, a device (100) for changing the direction of motion of a rail-bound vehicle with a feeding rail section (101), a removing rail section (103, 104), and a connecting rail section (102), which shows one motion, comprising at least one rotary motion about an axis (A) of the rotary motion, from a first position (p1, p2), in which the connecting rail section (102) is arranged in reference to the feeding rail section (101) such that the rail-bound vehicle can ride onto the connecting rail section (102), into a second position (p3, p4) in which the connecting rail section (102) is arranged in reference to the removing rail section (103, 104) such that the vehicle can ride onto the removing rail section (103, 104), characterized in that the connecting rail section (102) is mobile such that the motion of the connecting rail section (102) from a first position (p1, p2) into the second position (p3, p4) further comprises at least one translational motion of the connecting rail section (102) superimposing the rotary motion in a direction parallel in reference to the axis (A) of the rotary motion.

In another preferred embodiment, the device (100) for changing the direction of motion of a rail-bound vehicle as described herein, characterized in that the superimposition of the rotary motion and the translational motion leads to a helical motion.

In another preferred embodiment, the device (100) for changing the direction of motion of a rail-bound vehicle as described herein, characterized in that the translational motion is a falling motion.

In another preferred embodiment, the device (100) for changing the direction of motion of a rail-bound vehicle as described herein, characterized in that the motion of the connecting rail section (102) is driven and/or controlled such that the connecting rail section (102) on the path from the first position (p1, p2) to the second position (p3, p4) moves past the second position (p3, p4) at least once.

In another preferred embodiment, the device (100) for changing the direction of motion of a rail-bound vehicle as described herein, characterized in that the connecting rail section (102) performs a wobbling motion.

In another preferred embodiment, the device (100) for changing the direction of motion of a rail-bound vehicle as described herein, characterized in that the axis (A) is arranged eccentrically.

In another preferred embodiment, the device (100) for changing the direction of motion of a rail-bound vehicle as described herein, characterized in that the connecting rail section (102) can be moved such that the motion of the connecting rail section (102) out of the first position (p1, p2) into the second position (p3, p4) further comprises at least one translational motion of one end of the connecting rail section (102) superimposing the rotary motion in a direction parallel in reference to the axis (A) of the rotary motion and an opposite translational motion of the other end of the connecting rail section (102).

In another preferred embodiment, the device (100) for changing the direction of motion of a rail-bound vehicle as described herein, characterized in that the device (100) comprises means for generating an oscillating motion of the connecting rail section (102) about the second position (p3, p4).

In another preferred embodiment, the device (100) for changing the direction of motion of a rail-bound vehicle as described herein, characterized in that the connecting rail section (102) is guided on a guide rail (108) such that the progression of the guide rail (108) represents a mandatory curve of the motion.

In another preferred embodiment, the device (100) for changing the direction of motion of a rail-bound vehicle as described herein, characterized in that the guide rail (108) describes a closed curve in the space.

In another preferred embodiment, the device (100) for changing the direction of motion of a rail-bound vehicle as described herein, characterized in that the distance of the individual sections of the guide rail (108) from the axis (A) of the rotary motion is constant in all directions perpendicular in reference to the axis (A) of the rotary motion.

In another preferred embodiment, the device (100) for changing the direction of motion of a rail-bound vehicle as described herein, characterized in that different sections of the guide rail (108) are distanced from each other in the direction parallel to the axis (A) of the rotary motion.

In another preferred embodiment, the device (100) for changing the direction of motion of a rail-bound vehicle as described herein, characterized in that the spatial curve described by the guide rail (108) in at least one section of the guide rail (108) at which the connecting rail section (102) is guided shows a minimum when it is in the second position (p3, p4).

In another preferred embodiment, the device (100) for changing the direction of motion of a rail-bound vehicle as described herein, characterized in that a drive is provided for displacing the connecting rail section (102) from the second position (p3, p4) into the first position (p1, p2).

In another preferred embodiment, a rail-bound ride, particularly a rollercoaster, comprising a device (100) for changing the direction of travel of a rail-bound vehicle according to one of the previous claims.

In another preferred embodiment, the rail-bound ride as described herein, characterized in that the device (100) for changing the direction of travel of a rail-bound vehicle is installed such that the potential energy at the first position (p1, p2) is higher in reference to the ground than the one at the second position (p3, p4).

In another preferred embodiment, the method for operating a device (100) for changing the direction of travel of a rail-bound vehicle with a feeding rail section (101), a removing rail section (103, 104), and a connecting rail section (102), which is arranged by a rotary motion about an axis (A) and a hoisting or lowing motion superimposing the rotary motion from a first position (p1, p2) in which the connecting rail section (102) is arranged in reference to the feeding rail section (101) such that the rail-bound vehicle can ride onto the connecting rail section (102), is moved into a second position (p3, p4) in which the connecting rail section (102) is arranged in reference to the removing rail section (103, 104) such that the vehicle can ride onto the removing rail section (103, 104) with the steps:

moving the connecting rail section (102) into the first position (p1, p2), moving the rail-bound vehicle via the feeding rail section (101) onto the connecting rail section (102), moving the connecting rail section (102) from the first position (p1, p2) into the second position (p3, p4), and guiding the rail-bound vehicle from the connecting rail section (102) onto the removing rail section (103, 104), characterized in that the moving of the connecting rail section (102) from the first position (p1, p2) into the second position (p3, p4) is performed such that the connecting rail section (102) on the path from the first position (p1, p2) to the second position (p3, p4), performs at least one rotary motion about an axis of rotation and a translational motion superimposing a rotary motion parallel in reference to the axis (A) of the rotary motion.

In another preferred embodiment, the method for operating a device (100) for changing the direction of travel of a rail-bound vehicle as described herein, characterized in that the connecting rail section (102) is guided at least once past the second position (p3, p4) during the motion from the first position (p1, p2) into the second position (p3, p4).

In another preferred embodiment, the method for operating a device (100) for changing the direction of travel of a rail-bound vehicle as described herein, characterized in that the motion of the connecting rail section (102) from the first position (p1, p2) into the second position (p3, p4) occurs in the form of an oscillating motion.

In another preferred embodiment, the method for operating a device (100) for changing the direction of travel of a rail-bound vehicle as described herein, characterized in that the motion of the connecting rail section (102) from the first position (p1, p2) into the second position (p3, p4) is caused by the effect of gravity.

DETAILED DESCRIPTION OF THE INVENTION

Figure 1A:
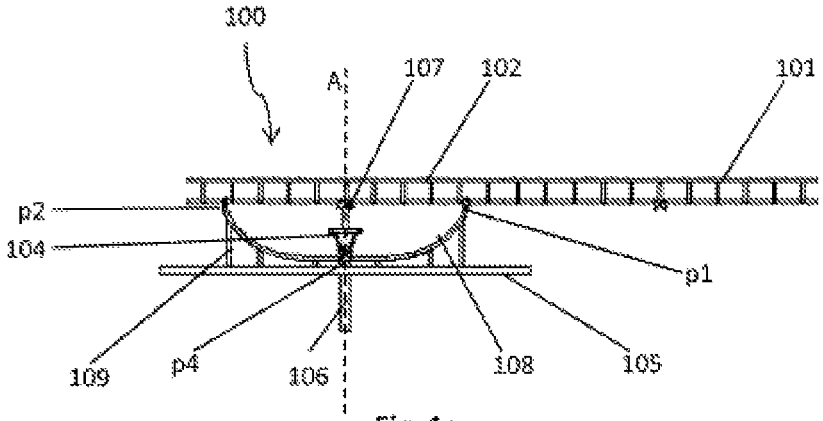
FIG. 1*a* is a line drawing evidencing a side view of an embodiment of a device for changing the direction of travel of a rail-bound vehicle in a first position in which the connecting rail section is arranged in reference to the feeding rail section such that the rail-bound vehicle (not shown) can ride onto the connecting rail section.

The device according to the invention for changing the direction of motion of a rail-bound vehicle comprises (at least) one feeding rail section, (at least) one removing rail section, and a connecting rail section, which by a motion, representing at least a rotary motion about an axis of rotation, i.e. a rotation about the axis of rotation by an angle of rotation amounting particularly less than 360°, can move the rail out of a first position in which the connecting rail section is arranged in reference to the feeding rail section such that the rail-bound vehicle can ride onto the connecting rail section into a second position, in which the connecting rail section is arranged in reference to the removing rail section such that the vehicle can run onto the removing rail section. Here the term "direction of rotation" in the sense of the invention includes both rotary motions about an axis in which the distance from said axis remains constant as well as those in which the distance from the axis changes such that in a level perpendicular to the direction of rotation both a circular motion as well as a helical or elliptical motion can occur.

When in the following, in the interest of a brief formulation, the first position and/or the second position of the connecting rail section are discussed, this always refers to a first position that can be achieved by a motion in which the connecting rail section is arranged in reference to the feeding rail section such that the rail-bound vehicle can ride onto the connecting rail section or the second position in which the connecting rail section is arranged in reference to the removing rail section such that the vehicle can ride onto the removing rail section.

Here it shall also be mentioned that the precise type of rail is irrelevant. The invention can be realized not only with track-like rail constructions, but also with single-rail systems, magnetic rail systems, or hover-train systems, for example.

It is essential for the invention that the connecting rail section is mobile in such a fashion that the motion of the connecting section out of a first position into a second position further comprises at least one translational motion of the connecting rail section superimposed over at least one rotary motion in a direction parallel to the axis of the rotary motion, particularly a lowering of the connecting rail section. In particular, a rotary drop switch can be realized, in which a falling motion is superimposing a rotary motion in order to further increase the thrill when using a ride on the one hand by playing with the fear of the rider from (free) falling and on the other hand by the fact that in such motions it is harder to predict in what direction the ride continues.

Such a raising or lowering of the connecting rail section can be realized with regards to technology for example by raising the connecting rail section with a hydraulic or mechanic hoisting system. As explained in greater detail in the following, particularly the lowering of the connecting rail section is also possible without any drive. It is particularly preferred for the lowering of the connecting rail section to occur by way of free fall.

In particular, in such a superimposition of motions here, a helical motion can develop.

It is further particularly preferred for the translational motion to be embodied as a dropping motion.

According to a particularly preferred further development of the invention, the motion of the connecting rail section is driven and/or controlled such that the connecting rail section moves on the path from the first position towards the second position at least once past the second position, which is particularly the case when the rotation occurs initially in one direction further towards the second position and then is continued in the opposite direction. As particularly discernible from this example, here the path of the connecting rail section shall be considered the entire section traveled by the connecting rail section before it finally reaches the second position and comes to rest here so that the vehicle can ride onto the removing rail section for continuing the ride.

The amusement is here not only increased by the change of direction of travel connected thereto, but particularly also by the user initially being seemingly deceived in the certain expectation that the travel continues via the removing rail section, and instead the ride could continue into an empty void.

The alternatives "driven" and "controlled" are here distinguished in that a driven motion is considered when the effect is achieved by a device showing a drive. As described in greater detail in the following using an example, however under certain circumstances here potential energy of the connecting rail section can also be used in order to cause the motion of the connecting rail section. In this case the motion is only controlled by guides (which can be used in general also for driven motions).

Additional thrills of the amusing ride are also achieved by superimposing additional degrees of freedom of movement. For example, the connecting rail section can be set into a wobbling motion, or the axis of rotation may be arranged eccentrically.

Alternatively or additionally the connecting rail section can also be moved such that the motion of the connecting rail section out of the first position into the second position further occurs by a translational motion superimposing the rotary motion of one end of the connecting rail section in a direction parallel to the axis of the rotary motion and a translational motion opposite of the other end of the connecting rail section, thus comprising overall a tipping motion of the connecting rail section. Such a motion allows for example in a first position of the rail-bound vehicle that the rail-bound vehicle rides essentially parallel to the ground onto the connecting rail section and then directly transfers in the second position into a schuss ride. This can be realized for example by providing an appropriate joint at the connecting rail section, with the motion with regards to this degree of freedom potentially being realized by a separate drive or by implementing (mechanic) mandatory conditions.

A measure further increasing the amusement includes equipping the device with means for generating an oscillating motion of the connecting rail section about the second position. This can be realized for example by controlling a motor which then appropriately varies the direction of rotation, but also by mechanical means.

It is particularly preferred for the connecting rail section to be guided on a guide rail such that the progression of the guide rail represents a mandatory curve of the motion. This way, by using systems driven by their potential energy the curve of the track can influence the motion of the connecting rail section in the desired fashion. Another advantage of such an arrangement, which occurs particularly in driven systems, is given in that only one drive needs to be provided for the rotary motion because any additional hoisting and/or tipping motion can then simply be forced by the guidance of the connecting rail section on the mandatory curve, which generally is considerably more beneficial than any synchronized, controlled additional drive, e.g., a hydraulic one, for the hoisting or tipping motion.

Such guidance can be realized on a guide rail, particularly such that e.g., runners, a beam hoist, or a sled being arranged at the connecting rail section traveling on or under the guide rail. In some embodiments of the mandatory curve, particularly those leading to an additional tipping motion of the connecting rail section, it is here beneficial when the runners, the beam hoist, or the sled are arranged in a fashion displaceable in reference to the connecting rail section, in order to allow the desired motion of the connecting rail section when traveling over the mandatory curve.

Here it is particularly advantageous when the guide rail describes a closed curve in a space because then the connecting rail section can return from the second position by a simple continuation of the rotary motion, which brought it from the first position into the second position, back into the first position and thus allows a cyclical operation.

In a geometry particularly preferred for a rotary motion and a hoisting-dropping motion combined therewith, the distance of the guide rail from the axis of the rotary motion is constant in all directions positioned perpendicular in reference to the axis of rotary motion. Due to the fact that different sections of the guide rail are distanced from each other in the direction parallel in reference to the axis of the rotary motion, here by the guide rail in a simple fashion also a hoisting and dropping motion of the connecting rail section can be generated.

In another further detailed embodiment of the guide rail the spatial curve described by the guide rail shows a minimum in the section of the guide rail at which the connecting rail section is guided when it is in the second position, i.e. shows at least one local, preferably a global minimum, though. This allows in an installation of the device in a rail-bound ride, which occurs in a fashion such that the minimum is equivalent to a minimum of the potential energy within the gravity of the earth, by using the earth's gravity applying upon the connecting rail section, to perform the movement from the first position into the second position.

In order to allow the comfortable return of the device to change the direction of motion of a rail-bound vehicle into the initial position, it is beneficial when a drive is provided for moving the connecting rail section from the second position into the first position.

The rail-bound ride according to the invention, which may particularly represent a rollercoaster, is characterized in that the rail system comprises a device for changing the direction of motion of a rail-bound vehicle according to one of the previous claims.

In a preferred embodiment of the rail-bound ride the device for changing the direction of motion of a rail-bound vehicle is installed such that the potential energy is greater at the first position in reference to the ground than at the second position. Here it is particularly advantageous when the potential energy developing at the first position is maximal and minimal at the second position.

This allows operating the device as an essentially gravity-driven rotary drop switch. Here, the first position may be embodied as a labile equilibrium position, for example by providing an appropriately shaped guide rail, which when the vehicle rides upon it is fixed on the connecting rail section with a fastening mechanism and upon said fastening mechanism being released and/or by a potential pulse being triggered causing the position of equilibrium to be altered, and here a combined rotary-drop motion begins to develop driven by gravity. Accordingly, at the point of time at which it was at the second position for the first time the connecting rail section shows kinetic energy and initially continues its travel passing the second position.

When at the second position a (local or global) minimum of the potential energy is given, over the course of the further motion of the connecting rail section its kinetic energy is converted back into potential energy until this conversion process has been completed. Subsequently the connecting rail section, driven by the potential energy, continues to move in the opposite direction, thus back in the direction to the second position. Thus an oscillating motion of the connecting rail section develops around the second position, which is damped by the friction loss of the support of the connecting rail section, unless the connecting rail section is caught at the second position by a catching mechanism.

For reasons of completeness it shall be mentioned that an oscillation of the connecting rail section around the second position, as described above, does not mandatorily require a guide rail showing the above-described design. For example, alternatively a catching system may be provided supported by springs and catching the connecting rail section at the second position. The kinetic energy of the connecting rail system at the second position is then converted into spring tension, thus potential energy of the spring, which then causes the change of the direction of motion back into the direction towards the second position.

The method according to the invention for operating a device to change the direction of motion of a rail-bound vehicle with a feeding rail section, a removing rail section, and a connecting rail section, which is arranged by a rotary motion and a superimposing hoisting or dropping motion can be moved from a first position, in which the connecting rail section is arranged in reference to the feeding rail section such that the rail-bound vehicle can ride onto the connecting rail section, into a second position, in which the connecting rail section is arranged in reference to the removing rail section such that the vehicle can ride onto the removing rail section, and comprises at least the steps:

moving the connecting rail section into the first position, guiding the rail-bound vehicle via the feeding rail section to the connecting rail section, moving the connecting rail section from the first position into the second position, and guiding the rail-bound vehicle from the connecting rail section to the removing rail section.

Here it is essential for the invention that the motion of the connecting rail section comprises at least a rotary motion from the first position into the second position about an axis of rotation and a superimposing translational motion the rotary motion parallel in reference to the axis (A) of the rotary motion. Here it is particularly preferred for the translational motion to be a falling motion.

An advantageous further development of the method provides that the motion of the connecting rail section from the first position into the second position is performed such that the connecting rail section on the path from the first position to the second position is guided past the second position at least once. This can be realized particularly such that the motion of the connecting rail section from the first position into the second position occurs in the form of a—particularly damped—oscillating motion, thus as a motion which initially guides past the second position and then oscillates with preferably reducing maximal distances from the second position about said second position.

It is particularly advantageous when the motion of the connecting rail section is caused by the effects of gravity, because this way the feeling of free falling is amplified. In this case preferably only the motion of the connecting rail section into the first position is caused by a motor or drive.

However, it is also possible to allow all motions of the connecting rail section being performed by drives appropriately controlled by a programmed control unit.

DETAILED DESCRIPTION OF THE FIGURES

Due to the fact that FIGS. 1*a* to 1*d* each show the same embodiment of the invention, here the same reference characters are used. In order to improve visibility of the figures, not all reference characters are included in every figure. Due to the symmetry of the exemplary embodiment, there are respectively two first positions p1, p2 and two second positions p3, p4, which allow advancing thereto. When a connecting rail section is provided which for example allows a motion of the vehicle only in one direction, for example as a consequence of the embodiment of the drive mechanism on the rails for the vehicle, not shown, there are generally given only one first and one second position of a desired travel projection of the vehicle.

FIG. 1*a* shows a side view of a device 100 for changing the direction of motion of a rail-bound vehicle, not shown, with a feeding rail section 101, a connecting rail section 102, and removing rail sections 103, 104 In the illustration according to FIG. 1*a* the connecting rail section 102 is located in a first position p1 or p2, in which it directly abuts the feeding rail section 101 such that the rail-bound vehicle, not shown, can ride from the feeding rail section 101 onto the connecting rail section 102.

The provision of several removing rail sections 103, 104 allows to vary the travel progression and to design the progression of the ride as less predictable for the user, which may contribute to an elevated thrill ride. Additionally, it is generally possible to provide more than one feeding rail section.

The device 100 shows a base plate 105, in this example embodied in a circular fashion. In the center of the circular base plate 105 it is penetrated by a hollow cylinder 106, supported rotationally about an axis A in reference to the base plate 105, with a column 107 being guided in its interior, connected to a connecting rail section 102 and guided in the hollow cylinder 106, when a drive is activated, preferably also without a drive guided in a displaceable fashion and secured from rotation about the axis A. Alternatively, a rotary bearing of the hollow cylinder 106 may be waived as well, and instead the column 107 may be embodied in a displaceable and rotational fashion about the axis A.

These arrangements allow therefore a rotary motion of the connecting rail section 102 about the axis A and a hoisting or dropping motion of the connecting rail section 102 superimposing it in the direction parallel in reference to the axis A.

Figure 1B:
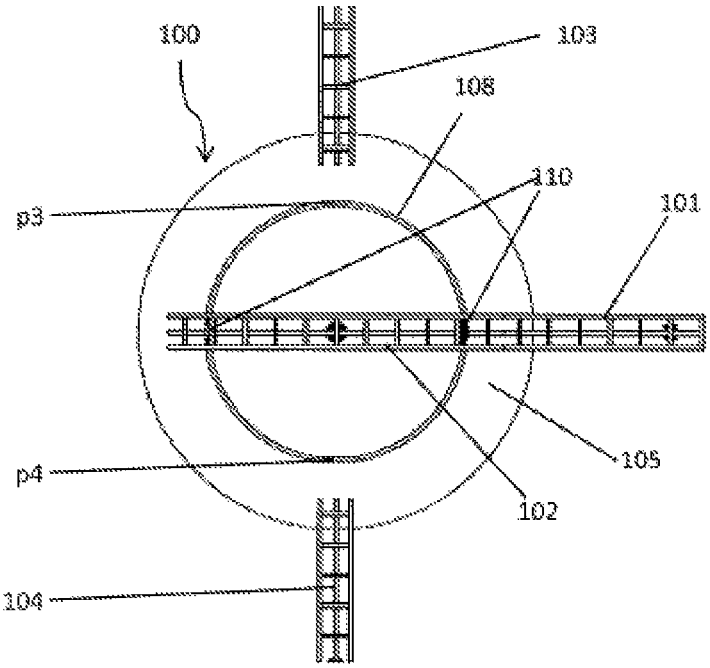
FIG. 1*b* is a line drawing evidencing a top view of an embodiment of FIG. 1*a* in the first position shown in FIG. 1*a*.
Figure 1C:
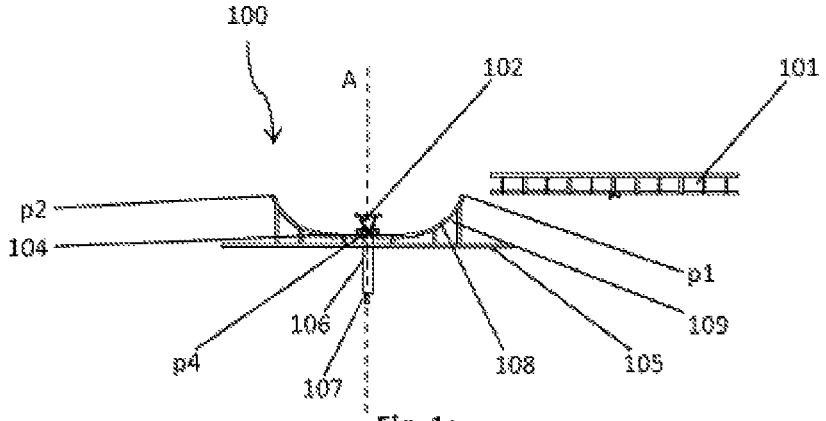
FIG. 1*c* is a line drawing evidencing a side view of the embodiment of FIG. 1*a* in a second position in which the connecting rail section is arranged in reference to the removing rail section such that the vehicle, not shown, can ride onto the removing rail section.

FIG. 1*c* shows a side view of the device 100 of FIG. 1*a* after the movement into a second position p3 or p4, in which the connecting rail section 102 is arranged in reference to the removing rail section 103, 104 such that the vehicle, not shown, can ride onto the removing rail section 103, 104. In order to reach the second position p2 from the first position p1, here the connecting rail section 102 must perform a rotary motion of the connecting rail section 102 about the axis A and a superimposing hoisting or dropping motion of the connecting rail section 102 it in the direction parallel to the axis A. Accordingly, in FIG. 1*c* the column 107, contrary to the situation in FIG. 1*a*, no longer exceeds the hollow cylinder 106 but projects from it downwards.

If as an additional degree of freedom of motion of the connecting rail section 102 a translational motion is desired superimposing the rotary motion of one end of the connecting rail section 102 in a direction parallel to the rotary motion about the axis A and an opposite translational motion of the other end of the connecting rail section 102, which however is not the case in the example shown here, the connection between the column 107 and the connecting rail section 102 must be embodied as a joint, and here means should be provided for fixing a potential translational motion of the entire connecting rail section 102 parallel in reference to the axis A of the rotary motion.

As further discernible from FIGS. 1*a* and 1*c*, furthermore a guide rail 108 is arranged at the base plate 105, which is fastened via braces 109 and on which the connecting rail section 102 is guided at both ends with guide elements 110. The guide elements 110 may e.g., represent guide wheels, a beam hoist, or a sled.

Figure 1D:
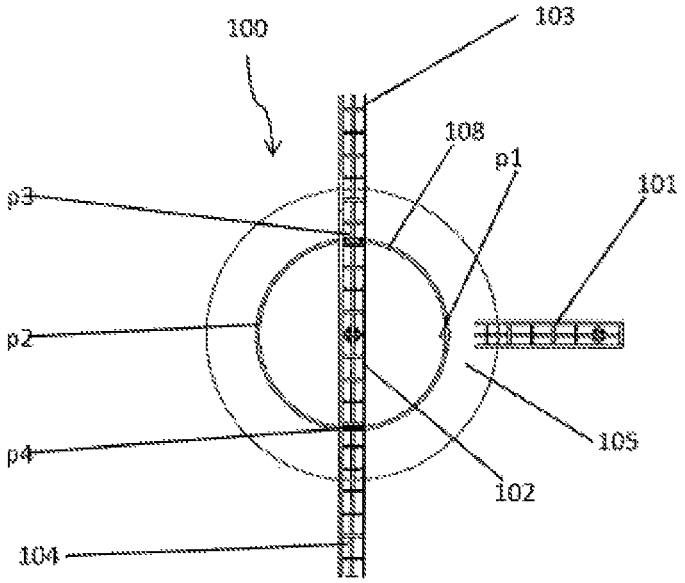
FIG. 1*d* is a line drawing evidencing a top view of the embodiment of FIG. 1*a* in the second position shown in FIG. 1*c*.

As discernible particularly clearly from FIGS. 1*b* and 1*d*, the guide rail 108 describes a closed curve in the space, which is formed in this exemplary embodiment such that the distance of the guide rail 108 from the axis A of the rotary motion is consistent in all directions aligned perpendicular to the axis of the rotary motion. However, this is not mandatory. In particular, in embodiments in which as an additional degree of freedom of motion of the connecting rail section 102 a superimposing translational motion of one end of the connecting rail section 102 is provided in a direction parallel to the axis A of the rotary motion and an opposite translational motion of the other end of the connecting rail section 102, here a deviation from this embodiment and/or an arrangement displaceable in reference to the connecting rail section 102 of the guide elements 110 may be beneficial at the connecting rail section 102.

Further, as discernible from FIGS. 1*a* and 1*c*, different sections of the guide rail 108 are distanced from each other in the direction parallel to the axis A of the rotary motion, namely such that in a base plate 105 aligned parallel to the ground, the guide rail 108 is located at those positions at which the connecting rail section 102 is guided when it is in the first position p1 or p2, as shown in FIG. 1*a*, with the height of the guide rail 108 being maximal in reference to the base plate 105 such that at this position p1 or p2 a maximum of the potential energy is given in the gravitational field of the earth. Contrary thereto, at those positions at which the connection rail section 108 is guided when it is located in the second position p3 or p4, the height of the guide rail is minimal in reference to the base plate 105 so that in this position a minimum of the potential energy in the gravitational field of the earth is given.

This embodiment allows that the motion of the connecting rail section 102 can occur as a gravity driven oscillating motion. After the rail-bound vehicle has rode onto the connecting rail section 102 located in the first position p1 or p2, preferably fixed in this position p1 or p2 during the riding motion, the connecting rail section 102 moves, driven by gravity (with the direction of rotation also being potentially predetermined by a short activation of a drive or an impact, alternatively also arbitrarily out of a labile position of equilibrium) in a combined rotary and dropping motion in the direction towards a second position p3 or p4, at this position p3 or p4 it oscillates past it due to the kinetic energy given there.

Accordingly, the connecting rail section 102 starts again to move up the guide rail 108, with here kinetic energy being converted back into potential energy until a reversal point is reached at which the conversion of the kinetic energy has completed. Due to given friction this reversal point will normally not be equivalent to the first position p1 or p2 but show a position at which the connecting rail section 102 shows a reduced potential energy.

The potential energy given at the reversal point is then converted into kinetic energy of a motion initially extending back in the direction towards the second position p3 or p4, which unless caught at the second position p3 or p4 again continues traveling to a reversal point, which due to friction once more will show a slightly lower potential energy than the initial point of the motion. This process will continue until the connecting rail section 102 has reached the minimum of the potential energy of the position of equilibration predetermined at the second position.

Overall, the connecting rail section 102 therefore performs a gravity driven, particularly also damped, oscillation about the second position p3 or p4. By selecting or changing the damping effect here the number of oscillations can be influenced until the position of equilibrium has been reached.

LIST OF REFERENCE NUMBERS

100 device
101 feeding rail section
102 connecting rail section
103, 104 removing rail section
105 base plate
106 hollow cylinder
107 column
108 guide rail
109 brace
110 guide element
A axis
p1, p2 first position
p3, p4 second position The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

We claim:

1. A device for changing the direction of motion of a rail-bound vehicle with a feeding rail section, a removing rail section, and a connecting rail section, which shows one motion, comprising at least one rotary motion about an axis of the rotary motion, from a first position, in which the connecting rail section is arranged in reference to the feeding rail section such that the rail-bound vehicle can ride onto the connecting rail section, into a second position in which the connecting rail section is arranged in reference to the removing rail section such that the vehicle can ride onto the removing rail section, characterized in that the connecting rail section is mobile such that the motion of the connecting rail section from a first position into the second position further comprises at least one translational motion of the connecting rail section superimposing the rotary motion in a direction parallel in reference to the axis of the rotary motion, wherein the connecting rail section is guided on a guide rail such that the progression of the guide rail represents a mandatory curve of the motion and wherein the guide rail describes a closed curve in space.

2. The device for changing the direction of motion of a rail-bound vehicle according to claim 1, wherein the superimposition of the rotary motion and the translational motion leads to a helical motion.

3. The device for changing the direction of motion of a rail-bound vehicle according to claim 1, wherein the translational motion is a falling motion.

4. The device for changing the direction of motion of a rail-bound vehicle according to claim 1, wherein the motion of the connecting rail section is driven and/or controlled such that the connecting rail section on the path from the first position to the second position moves past the second position at least once.

5. The device for changing the direction of motion of a rail-bound vehicle according to claim 1, wherein the connecting rail section performs a hoisting and tipping motion.

6. The device for changing the direction of travel of a rail-bound vehicle according to claim 5, wherein the distance of the individual sections of the guide rail from the axis of the rotary motion is constant in all directions perpendicular in reference to the axis of the rotary motion.

7. The rail-bound ride according to claim 6, wherein the device for changing the direction of travel of a rail-bound vehicle is installed such that the potential energy at the first position is higher in reference to the ground than the one at the second position.

8. The device for changing the direction of travel of a rail-bound vehicle according to claim 5, wherein different sections of the guide rail are distanced from each other in the direction parallel to the axis of the rotary motion.

9. The device for changing the direction of travel of a rail-bound vehicle according to claim 1, wherein the axis is arranged eccentrically.

10. The device for changing the direction of travel of a rail-bound vehicle according to claim 1, wherein the connecting rail section can be moved such that the motion of the connecting rail section out of the first position into the second position further comprises at least one translational motion of one end of the connecting rail section superimposing the rotary motion in a direction parallel in reference to the axis of the rotary motion and an opposite translational motion of the other end of the connecting rail section.

11. The device for changing the direction of travel of a rail-bound vehicle according to claim 1, wherein the device comprises means for generating an oscillating motion of the connecting rail section about the second position.

12. The device for changing the direction of travel of a rail-bound vehicle according to claim 11, wherein the spatial curve described by the guide rail in at least one section of the guide rail at which the connecting rail section is guided shows a minimum when it is in the second position.

13. The device for changing the direction of travel of a rail-bound vehicle according to claim 1, wherein a drive is provided for displacing the connecting rail section from the second position into the first position.

14. A rail-bound ride, comprising a device for changing the direction of travel of a rail-bound vehicle according to claim 1.

15. A method for operating a device for changing the direction of travel of a rail-bound vehicle with a feeding rail section, a removing rail section, and a connecting rail section, which is arranged by a rotary motion about an axis and a hoisting or lowing motion superimposing the rotary motion from a first position in which the connecting rail section is arranged in reference to the feeding rail section such that the rail-bound vehicle can ride onto the connecting rail section, is moved into a second position in which the connecting rail section is arranged in reference to the removing rail section such that the vehicle can ride onto the removing rail section, wherein the connecting rail section is guided on a guide rail such that the progression of the guide rail represents a mandatory curve of the motion and wherein the guide rail describes a closed curve in space, with the steps moving the connecting rail section into the first position, moving the rail-bound vehicle via the feeding rail section onto the connecting rail section, moving the connecting rail section from the first position into the second position, and guiding the rail-bound vehicle from the connecting rail section onto the removing rail section, wherein the moving of the connecting rail section from the first position into the second position is performed such that the connecting rail section on the path from the first position to the second position, performs at least one rotary motion about an axis of rotation and a translational motion superimposing a rotary motion parallel in reference to the axis of the rotary motion.

16. The method according to claim 15, wherein the connecting rail section is guided at least once past the second position during the motion from the first position into the second position.

17. The method according to claim 16, wherein the motion of the connecting rail section from the first position into the second position occurs in the form of an oscillating motion.

18. The method according to claim 15, wherein the motion of the connecting rail section from the first position into the second position is caused by the effect of gravity.

* * * * *